US008942599B2

(12) United States Patent
Kim et al.

(10) Patent No.: US 8,942,599 B2
(45) Date of Patent: Jan. 27, 2015

(54) IMAGE FORMING APPARATUS

(71) Applicant: SAMSUNG Electronics Co., Ltd., Suwon-si, Gyeonggi-do (KR)

(72) Inventors: Tae Hee Kim, Hwaseong-si (KR); Gi Cheol Jeong, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/649,401

(22) Filed: Oct. 11, 2012

(65) Prior Publication Data

US 2013/0094881 A1 Apr. 18, 2013

(30) Foreign Application Priority Data

Oct. 12, 2011 (KR) ..... 10-2011-0104017

(51) Int. Cl.
*G03G 21/16* (2006.01)
*G03G 15/00* (2006.01)
*G03G 15/08* (2006.01)

(52) U.S. Cl.
CPC ..... *G03G 15/0896* (2013.01); *G03G 21/1623* (2013.01); *G03G 21/1647* (2013.01)
USPC ..... 399/167; 399/110

(58) Field of Classification Search
CPC ..... G03G 21/1842; G03G 21/1853
USPC ..... 399/167
See application file for complete search history.

(56) References Cited

U.S. PATENT DOCUMENTS

| | | | | |
|---|---|---|---|---|
| 7,130,562 | B2 * | 10/2006 | Foster et al. | 399/112 |
| 7,415,224 | B2 * | 8/2008 | Hayakawa | 399/111 |
| 7,809,288 | B2 * | 10/2010 | Okano | 399/13 |
| 8,126,366 | B2 * | 2/2012 | Hattori | 399/167 |
| 8,270,877 | B2 * | 9/2012 | Tomatsu et al. | 399/167 |
| 2006/0260902 | A1 * | 11/2006 | Marumoto et al. | 192/89.2 |
| 2008/0124129 | A1 * | 5/2008 | Lee | 399/167 |
| 2009/0169244 | A1 * | 7/2009 | Carter et al. | 399/110 |
| 2011/0081163 | A1 * | 4/2011 | Lee | 399/110 |
| 2012/0148298 | A1 * | 6/2012 | Jeong et al. | 399/119 |

* cited by examiner

*Primary Examiner* — Clayton E Laballe
*Assistant Examiner* — Leon W Rhodes, Jr.
(74) *Attorney, Agent, or Firm* — Staas & Halsey LLP

(57) ABSTRACT

An image forming apparatus includes a main body, a cover to open and close a front of the main body, a tray slidably mounted in the main body through the front of the main body, at least one developing cartridge mounted in the main body in a state in which the developing cartridge is received in the tray, at least one driving coupler member provided at one side of the main body to drive the developing cartridge mounted in the main body, a link member operating simultaneously with opening and closing of the cover to move in a first direction, and a guide member to support the at least one driving coupler member, the guide member operating simultaneously with the link member to move in a second direction perpendicular to the first direction, wherein the guide member is pressed by the link member, when the cover opens the main body, to separate the driving coupler member from the developing cartridge.

28 Claims, 16 Drawing Sheets

IMAGE FORMING APPARATUS

CROSS-REFERENCE TO RELATED APPLICATIONS

This application claims the benefit of Korean Patent Application No. 2011-0104017, filed on Oct. 12, 2011 in the Korean Intellectual Property Office, the disclosure of which is incorporated herein by reference in its entirety.

BACKGROUND OF THE INVENTION

1. Field of the Invention

Embodiments of the present inventive concept relate to an image forming apparatus with a driving structure to drive a developing cartridge.

2. Description of the Related Art

An image forming apparatus forms an image on printing media according to an input signal. The image forming apparatus includes a printer, copier, facsimile and a multifunction device having functions of the printer, copier, and facsimile.

An electrophotographic image forming apparatus, which is a kind of image forming apparatus, includes a developing cartridge including an image carrier and a developing device and an optical scanning unit. The optical scanning unit scans light to the image carrier, which is charged with predetermined potential, to form an electrostatic latent image on the surface of the image carrier, and the developing device supplies a developing agent to the image carrier, on which the electrostatic latent image is formed, to form a visible image.

Generally, the image carrier and the developing device included in the developing cartridge are coupled to a coupler rotatably provided at a main body of the image forming apparatus in a state in which the developing cartridge is mounted in the main body to receive driving force necessary to form an image.

Particularly for an image forming apparatus having a structure in which the developing cartridge is coupled to a tray, which in turn is movably coupled to the main body, and is mounted in the main body through the tray, it may be necessary to move a coupler away from a moving route of the developing cartridge in order to prevent interference between the coupler and the developing cartridge when the tray is moved to mount the developing cartridge in the main body or to separate the developing cartridge from the main body.

In the conventional art, a rotary cam is formed at each coupler, and a stationary cam or horizontal cam having a shape corresponding to the rotary cam so that the stationary cam or horizontal cam engages with the rotary cam is provided, to move the coupler to drive the developing cartridge. However, the number of stationary cams is increased in correspondence to that of the rotary cams, thereby increasing the number of parts and increasing manufacturing costs. Also, a space in which the stationary cam is installed is increased, and therefore, it may be difficult to decrease the size of the image forming apparatus. For the horizontal cam, on the other hand, the direction in which force is applied from the horizontal cam to the rotary cam is different from the direction in which the rotary cam is moved, and therefore, it may be difficult to stably move the coupler as compared with the stationary cam.

SUMMARY OF THE INVENTION

The present inventive concept provides an image forming apparatus in which a driving structure to drive a developing cartridge mounted in a main body of the image forming apparatus is simplified.

The present inventive concept also provides an image forming apparatus with an improved driving structure in which the developing cartridge mounted in the main body of the image forming apparatus is stably mounted or separated.

Additional features and utilities of the present general inventive concept will be set forth in part in the description which follows and, in part, will be obvious from the description, or may be learned by practice of the general inventive concept.

Exemplary embodiments of the present inventive concept provide an image forming apparatus that includes a main body, a cover to open and close a front of the main body, a tray slidably mounted in the main body through the front of the main body opened by the cover, at least one developing cartridge mounted in the main body in a state in which the developing cartridge is received in the tray, at least one driving coupler member provided at one side of the main body to drive the developing cartridge mounted in the main body, a link member operating simultaneously with opening and closing of the cover to move in a first direction, and a guide member to support the at least one driving coupler member, the guide member operating simultaneously with the link member to move in a second direction perpendicular to the first direction, wherein the guide member is pressed by the link member, when the cover opens the main body, to separate the driving coupler member from the developing cartridge so that the developing cartridge and the driving coupler member do not interfere with each other when the tray is slid in the first direction.

The developing cartridge may include at least one driven coupler member coupled to or separated from the driving coupler member.

The developing cartridge may include an image carrier to form an image and a developing roller to supply a developing agent to the image carrier, and the at least one driven coupler member may be connected to the image carrier and/or the developing roller.

Pressing of the guide member by the link member may be released, when the cover closes the main body, to couple the driving coupler member to the developing cartridge so that the developing cartridge is driven by the driving coupler member.

The second direction may be identical to a rotational axial direction of the driving coupler member.

When the cover opens the main body, the guide member may be pressed by the link member to move in the second direction, and the driving coupler member may be pressed by the guide member to move in the second direction so that the driving coupler member is disposed at a first position where the driving coupler member is separated from the developing cartridge.

When the cover closes the main body, pressing of the guide member by the link member may be released so that the guide member moves in a direction opposite to the second direction, and pressing of the driving coupler member by the guide member may be released so that the driving coupler member moves in the direction opposite to the second direction and is disposed at a second position where the driving coupler member is coupled to the developing cartridge.

The image forming apparatus may include a support frame coupled to one side of the main body to rotatably support the driving coupler member, wherein the driving coupler member may include a rotary shaft rotatably coupled to the support frame, a coupler coupled to the rotary shaft so that the coupler moves in an axial direction of the rotary shaft, and a first elastic member disposed between the coupler and the support frame to press the coupler in a direction opposite to the second direction.

The guide member may include a guide protrusion protruding from one side thereof in the second direction, and the support frame may include a guide hole to guide the guide protrusion so that the guide member moves in the second direction or in a direction opposite to the second direction.

The image forming apparatus may include a second elastic member disposed between the guide member and the support frame to press the guide member in the direction opposite to the second direction.

The link member may include a pressing protrusion contacting the guide member, when the cover opens the main body, to press the guide member.

The guide member may include a receiving part to receive the pressing protrusion, when the cover closes the main body, so that the pressing protrusion does not interfere with the link member.

The guide member may include at least one receiving hole formed at a position corresponding to the driving coupler member to receive the driving coupler member so that the driving coupler member is coupled to the developing cartridge without interference with the guide member.

Exemplary embodiments of the present inventive concept also provide an image forming apparatus that includes a main body, a cover to open and close a front of the main body, a tray slidably mounted in the main body through the front of the main body opened by the cover, at least one developing cartridge mounted in the main body in a state in which the developing cartridge is received in the tray, the developing cartridge comprising an image carrier to form an image, a developing roller to supply a developing agent to the image carrier, and a plurality of driven coupler members connected to the image carrier and the developing roller, a plurality of driving coupler members provided at one side of the main body to transmit driving force generated from a driving source to the driven coupler members, a link member operating simultaneously with opening and closing of the cover to move in a first direction, the link member moving in a direction in which the tray is separated from the main body when the cover opens the main body and moving in a direction in which the tray is coupled to the main body when the cover closes the main body, and a guide member operating simultaneously with the link member to move in an axial direction of the driving coupler members, the guide member being pressed by the link member, when the cover opens the main body, to separate the driving coupler members from the driven coupler members, pressing of the guide member by the link member is released, when the cover closes the main body, to couple the driving coupler members to the driven coupler members.

The guide member may be pressed by the link member, when the cover opens the main body, to move in an axial direction of the driving coupler members in which the guide member moves away from the developing cartridge, and pressing of the guide member by the link member may be released, when the cover closes the main body, so that the guide member moves in the axial direction of the driving coupler members in which the guide member moves closer to the developing cartridge.

The link member may include a pressing protrusion protruding from one side thereof to press the guide member when the cover opens the main body.

The guide member may include a receiving part formed at a position corresponding to the pressing protrusion to receive the pressing protrusion when the cover closes the main body.

The driving coupler members may include at least one first driving coupler member to drive the developing roller and at least one second driving coupler member to drive the image carrier.

The image forming apparatus may include a first support frame disposed at one side of the main body to support various components constituting the image forming apparatus, a second support frame disposed outside the first support frame to rotatably support the at least one first driving coupler member, and a third support frame disposed outside the second support frame to rotatably support the at least one second driving coupler member.

The link member and the guide member may be disposed between the first support frame and the second support frame.

The first driving coupler member may include a first rotary shaft rotatably coupled to the second support frame, a first coupler coupled to the first rotary shaft so as to be movable in an axial direction of the first rotary shaft, and a first elastic member disposed between the first coupler and the second support frame to press the first coupler in a direction opposite to the second direction.

The first coupler may include a first flange formed by extending an outer circumference of the first coupler in a radial direction, and one side of the first flange may contact the first elastic member so that the first coupler is pressed by the first elastic member while the other side of the first flange contacts the guide member so that the first coupler is supported by the guide member.

The guide member may include a first guide protrusion protruding from one side thereof in the second direction, and the second support frame may include a first guide hole to guide the first guide protrusion so that the guide member is moved in the second direction or in a direction opposite to the second direction.

The first guide protrusion may be provided at one end thereof with a hook to prevent the guide member from being separated from the second support frame.

The third support frame may include a second guide protrusion protruding from one side thereof in a direction opposite to the second direction, and the guide member may include a second guide hole coupled to the second guide protrusion to guide the second guide protrusion.

The link member may include a third guide protrusion protruding from one side thereof in a direction opposite to the second direction, and the first support frame may include a guide slot to guide the third guide protrusion so that the link member is moved in the first direction or in a direction opposite to the first direction.

The image forming apparatus may include a rail member coupled to the cover and operating simultaneously with opening and closing of the cover to move in a first direction to guide sliding of the tray, wherein the link member may include a coupling protrusion protruding from one side thereof in a direction opposite to the second direction and coupled to the rail member so that the link member operates simultaneously with the rail member.

Exemplary embodiments of the present inventive concept also provide an image forming apparatus that includes a main body, a cover to open and close a front of the main body, a tray slidably mounted in the main body through the front of the main body opened by the cover, at least one developing cartridge mounted in the main body in a state in which the developing cartridge is received in the tray, a rail member coupled to the cover and operating simultaneously with opening and closing of the cover to move in a first direction to guide sliding of the tray, a link member operating simultaneously with the rail member to move in a first direction, a guide member operating simultaneously with the link member to move in a second direction perpendicular to the first direction, and at least one driving coupler member provided at one side of the main body to drive the developing cartridge mounted in the main body, the driving coupler member operating simultaneously with the guide member to move in the second direction.

Exemplary embodiments of the present inventive concept also provide an image forming apparatus, comprising: a main body; a cover to open and close a front portion of the main body; a tray slidably mounted in the main body through the front portion when the cover is opened; at least one developing cartridge mountable to the tray; at least one driving coupler member provided within the main body to drive a corresponding developer cartridge; an engaging unit coupled to the cover to engage the at least one driving coupler member to the corresponding developer cartridge when the cover is closed and to dis-engage the at least one driving coupler member from the corresponding developer cartridge when the cover is opened.

In an exemplary embodiment, the engaging unit may include: a link member including a protrusion extending from a side portion thereof and linked to the cover to move in first and second directions together with the cover; and a guide member to movably support the at least one driving coupler member and including a receiving groove in a side portion thereof, the guide member to move in third and fourth directions perpendicular to the first and second directions together with the at least one driving coupler member such that when the protrusion of the link member moves in the first direction to be received in the receiving groove the guide member moves the at least one driving coupler member in the third direction to couple with the corresponding developer cartridge and when the protrusion of the link member moves in the second direction to be separated from the receiving groove the guide member moves the at least one driving coupler member in the fourth direction to uncouple with the corresponding developer cartridge.

In an exemplary embodiment, the guide member moves in the third and fourth directions together with the at least one driving coupler member.

In an exemplary embodiment, the link member comprises: a main link body in which the protrusion extends therefrom; a guide slot extending from an end of the main link body adjacent the cover; and a connection link having a first end coupled to an inner portion of the cover, a second end coupled to the main body and a coupling protrusion disposed between the first end and the second end and extending outwardly to be coupled to the guide slot such that when the cover is opened the connection link moves the link member together with the cover.

In an exemplary embodiment, the image forming apparatus further comprises at least one driving member disposed within the main body in which the at least one driving coupler member corresponds; and an elastic member disposed between each of the at least one driving member and corresponding driving coupler member to extend outwardly to force the driving coupler member away from the corresponding driving member and toward the guide member, and to compress when the guide member moves the at least one driving coupler in the fourth direction.

Exemplary embodiments of the present inventive concept also provide a method of engaging at least one driving coupler with a respective developer cartridge of an image forming apparatus, the method comprising: operating a cover in the image forming apparatus such that an opening of the cover moves a link member in a first direction with the cover such that the link member forces a guide member guiding driving couplers to move in a second direction perpendicular to the first direction to uncouple the at least one driving coupler from the respective developer cartridge and a closing of the cover moves the link member in a third direction with the cover to release the force on the guide member such that the guide member guides the driving couplers to move in a fourth direction perpendicular to the third direction.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
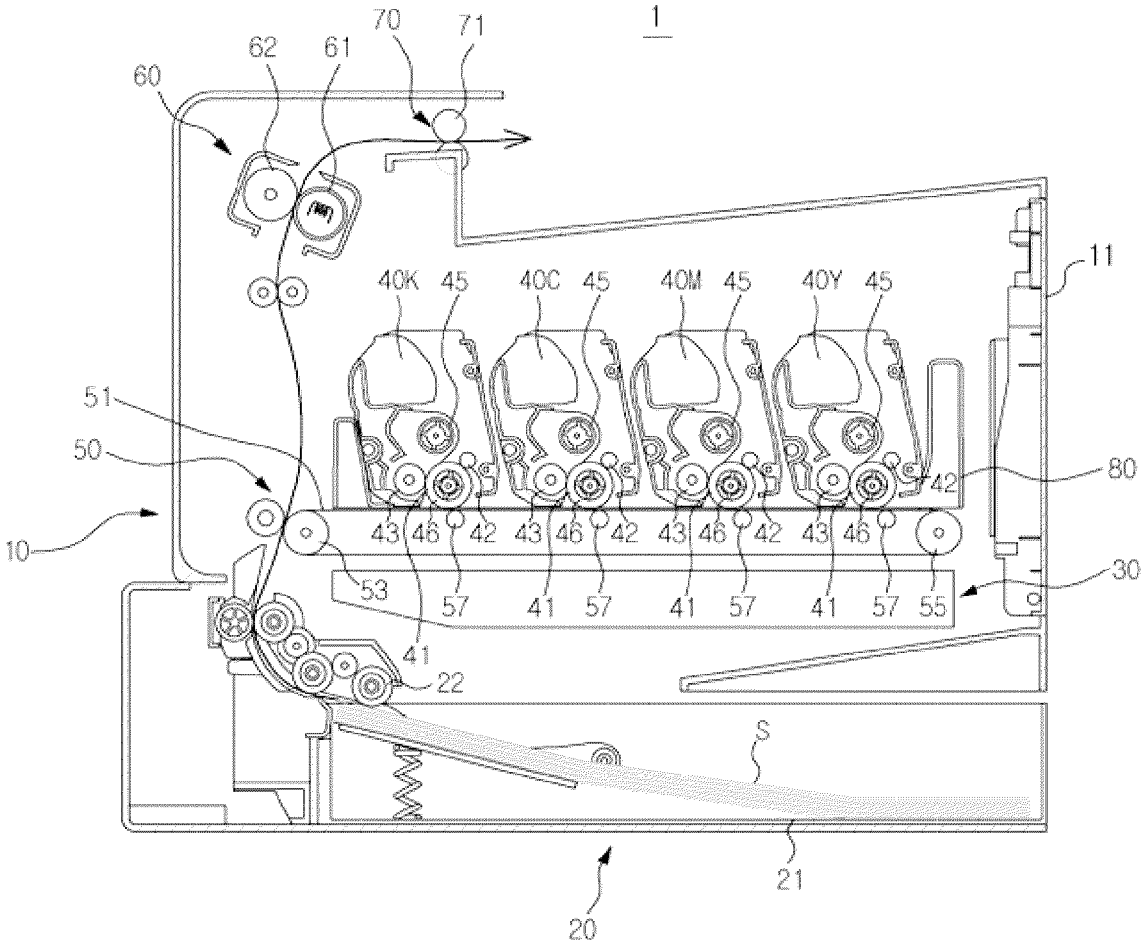
FIG. 1 is a view schematically showing the construction of an image forming apparatus according to an exemplary embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view schematically showing the construction of an image forming apparatus according to an exemplary embodiment of the present inventive concept.

As shown in FIG. 1, an image forming apparatus 1 includes a main body 10, a print media supply unit 20, an optical scanning unit 30, a developing cartridge 40, a transfer unit 50, a fusing unit 60, and a print media discharge unit 70.

The main body 10 forms the external appearance of the image forming apparatus 1 and supports various components installed therein. A cover 11 is rotatably installed at one side of the main body 10. The cover 11 opens and closes a portion of the main body 10. A user may access the interior of the main body 10 through the cover 11 to mount or separate components, such as the developing cartridge 40.

The print media supply unit 20 includes a cassette 21 in which print media S are stored, a pickup roller 22 to pick up the print media S stored in the cassette 21 one by one, and a feeding roller 23 to feed the picked-up print media S to the transfer unit 50.

The optical scanning unit 30 is disposed under the developing cartridge 40 to scan light corresponding to image information to an image carrier 41 so that an electrostatic latent image is formed on the surface of the image carrier 41.

The developing cartridge 40 may include four developing cartridges 40Y, 40M, 40C, and 40K to store different color developing agents, such as yellow (Y), magenta (M), cyan (C), and black (K) developing agents, respectively.

Each of the developing cartridges 40Y, 40M, 40C, and 40K has an image carrier 41, a charging roller 42, a developing roller 43, and a supply roller (not shown). An electrostatic latent image is formed on the surface of the image carrier 41 by the optical scanning unit 30. The charging roller 42 charges the image carrier 41 with predetermined potential. The supply roller (not shown) supplies a developing agent to the developing roller 43. The developing roller 43 attaches the developing agent to the surface of the image carrier 41, on which the electrostatic latent image is formed, to form a visible image. At one side of each of the developing cartridges 40Y, 40M, 40C, and 40K are provided driven coupler members 45 and 46, by which the image carrier 41 and the developing roller 43 are rotatably connected to driving coupler members 170 and 180 (see FIG. 2) provided at one side of the main body in a state in which each of the developing cartridges 40Y, 40M, 40C, and 40K is mounted to the main body 10.

The transfer unit 50 may include a transfer belt 51 to move in a cycle in contact with the image carrier 41 of each of the developing cartridges 40Y, 40M, 40C, and 40K, a driving roller 53 to drive the transfer belt 51, a tension roller 55 to tense the transfer belt 51, and four rollers 57 to transfer the visible image, developed on the image carrier 41 of each of the developing cartridges 40Y, 40M, 40C, and 40K, to print media S.

The fusing unit 60 includes a heating roller 61 having a heat source and a pressing roller 62 opposite to the heating roller 61. When the print media pass between the heating roller 61 and the pressing roller 62, the image is fixed to the print media by heat from the heating roller 61 and pressure between the heating roller 61 and the pressing roller 62.

The print media discharge unit 70, including a plurality of discharging rollers 71, discharges the print media, having passed through the fusing unit 60, out of the main body 10.

The developing cartridges 40Y, 40M, 40C, and 40K to form an image are each received in a tray 80 slidably coupled to the main body 10 and are mounted in the main body 10.

The image carrier 41 and the developing roller 43 rotatably provided at each of the developing cartridges 40Y, 40M, 40C, and 40K are driven by the driving coupler members 170 and 180 (see FIG. 2 and FIG. 4) provided at one side of the main body 10 in a state in which the developing cartridges 40Y, 40M, 40C, and 40K are mounted in the main body 10.

Figure 2:
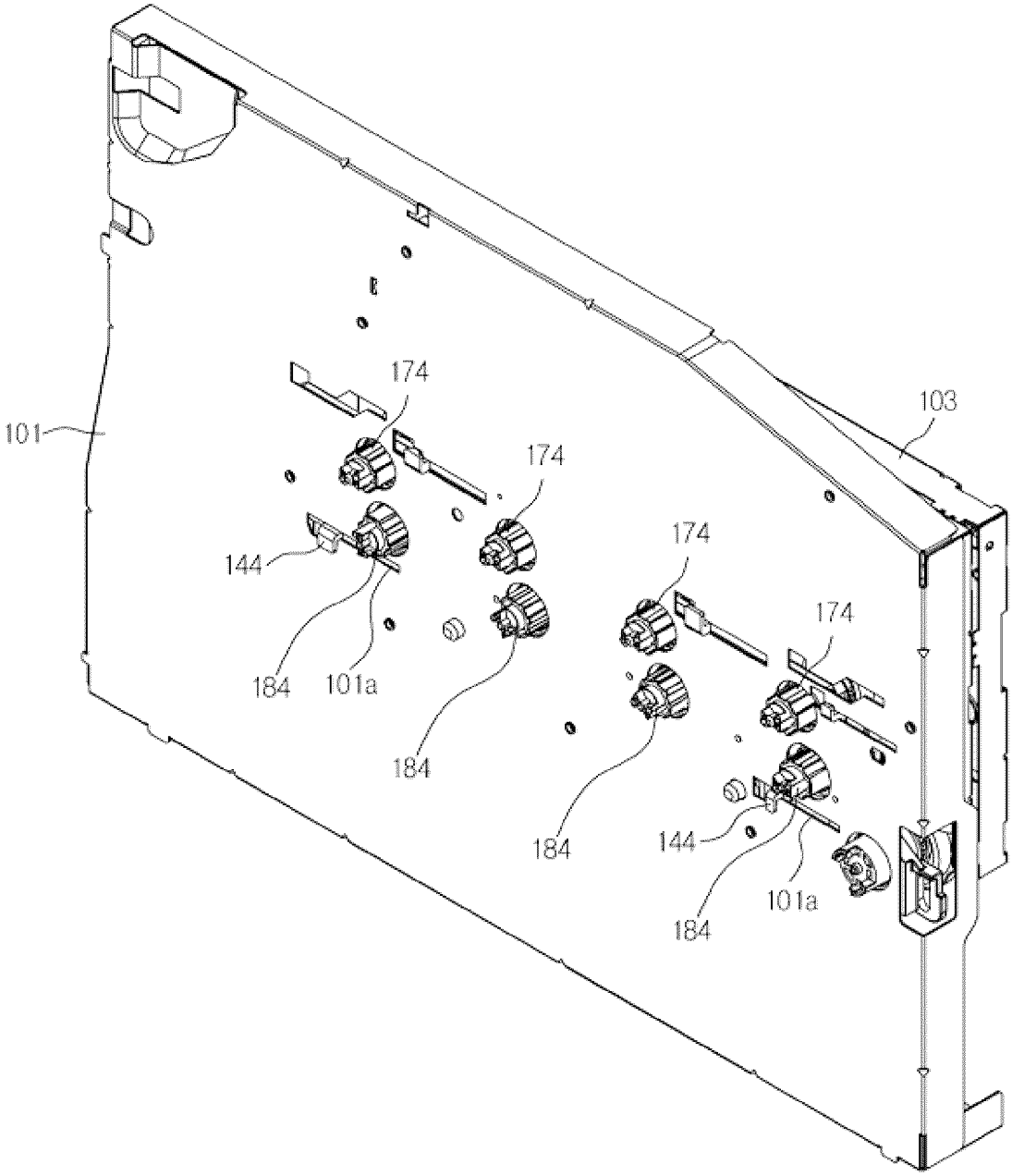
FIG. 2 is a view showing a driving structure according to an embodiment of the present inventive concept to drive a developing cartridge of FIG. 1.
Figure 3:
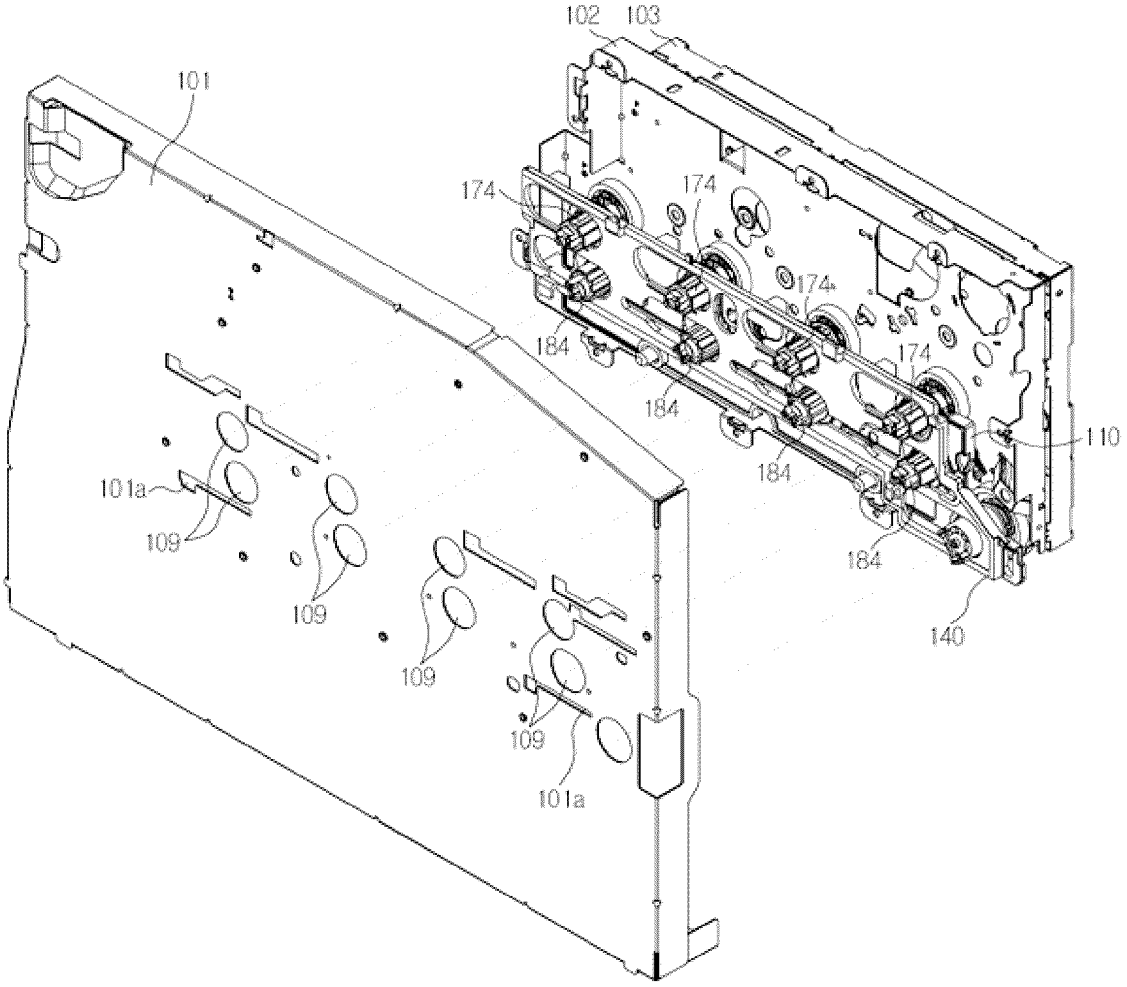
FIG. 3 is an exploded view of the construction shown in FIG. 2.
Figure 4:
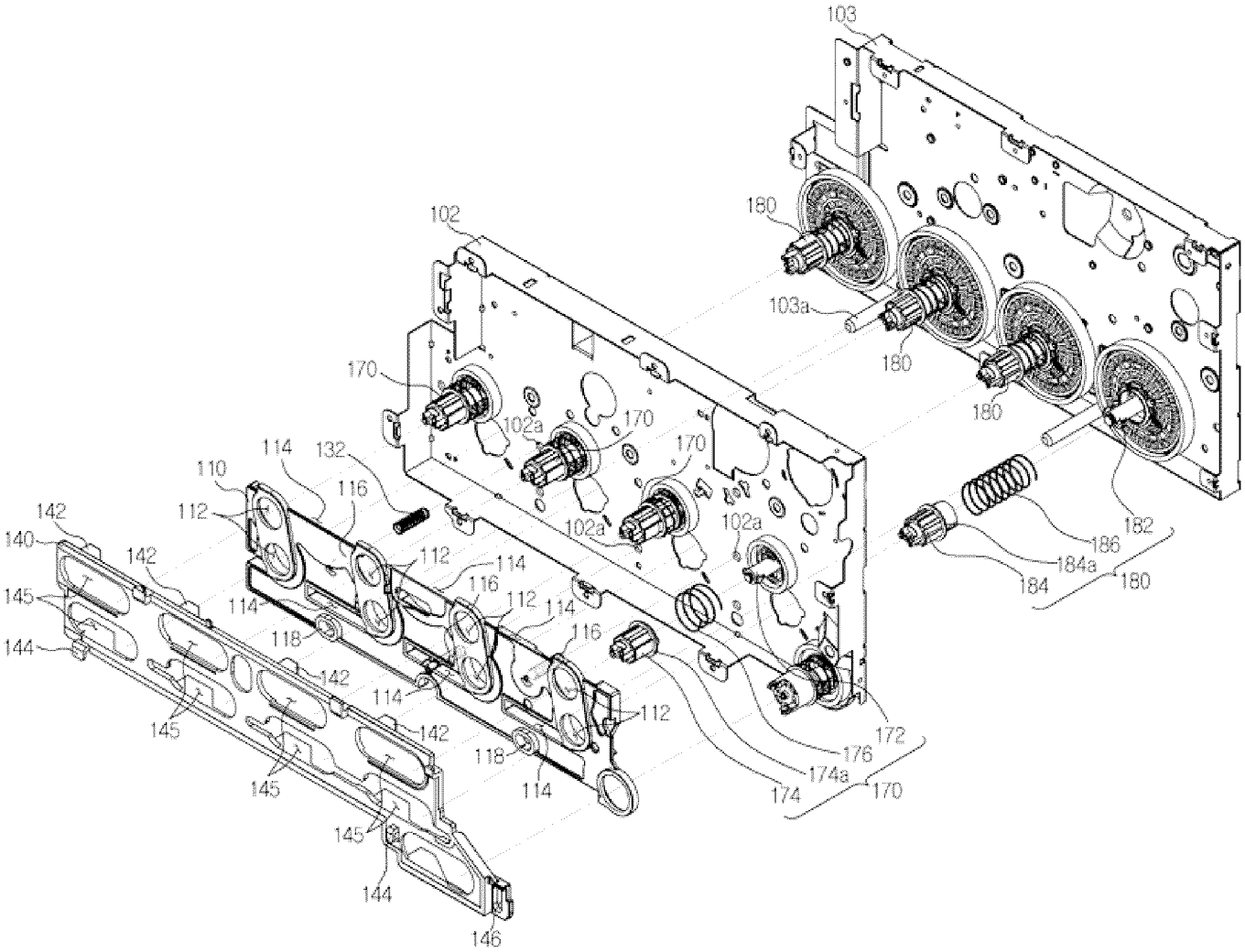
FIG. 4 is an exploded view of the construction shown in FIG. 2.
Figure 5:
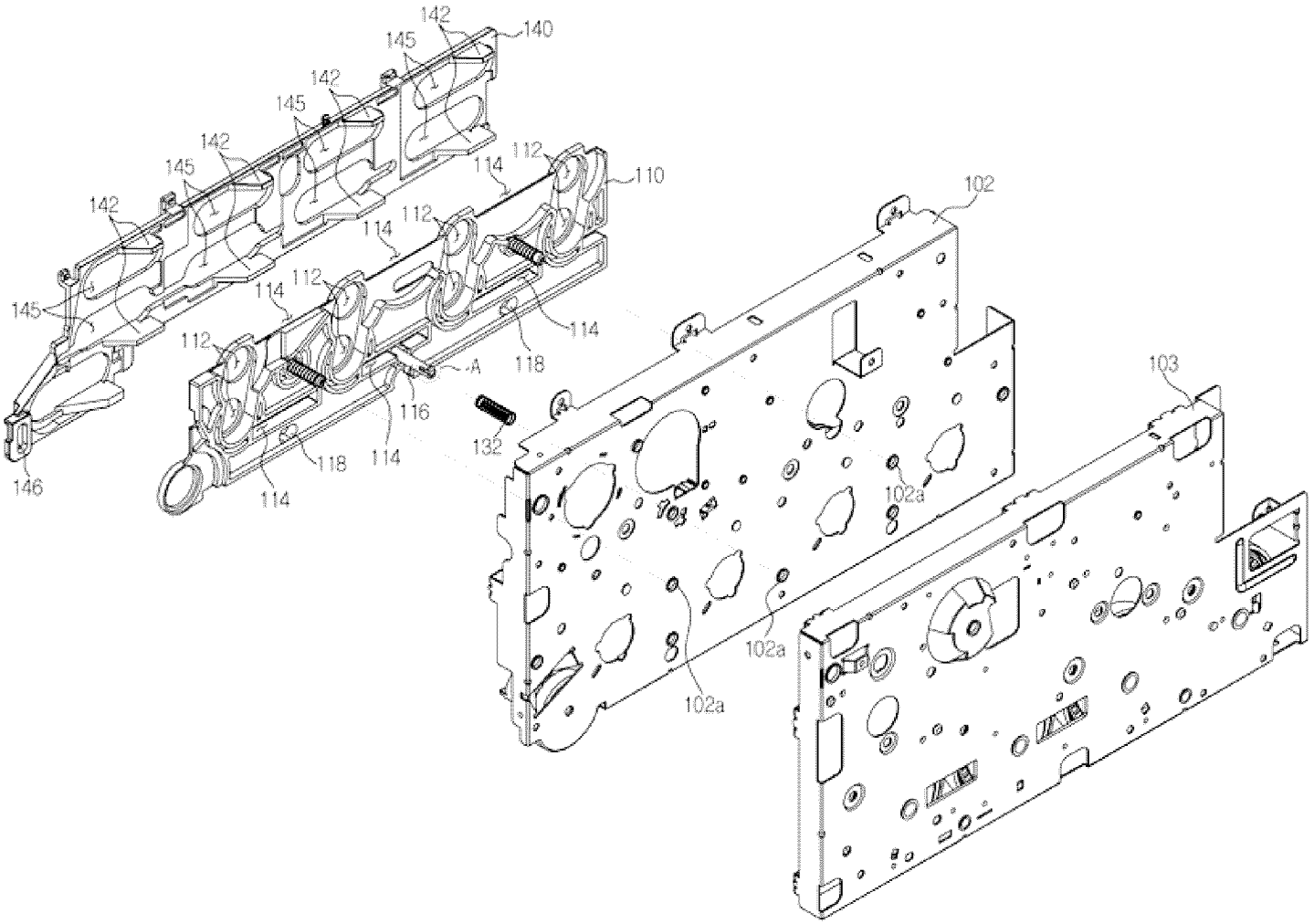
FIG. 5 is an exploded view of the construction shown in FIG. 4 when viewed from another angle.
Figure 6:
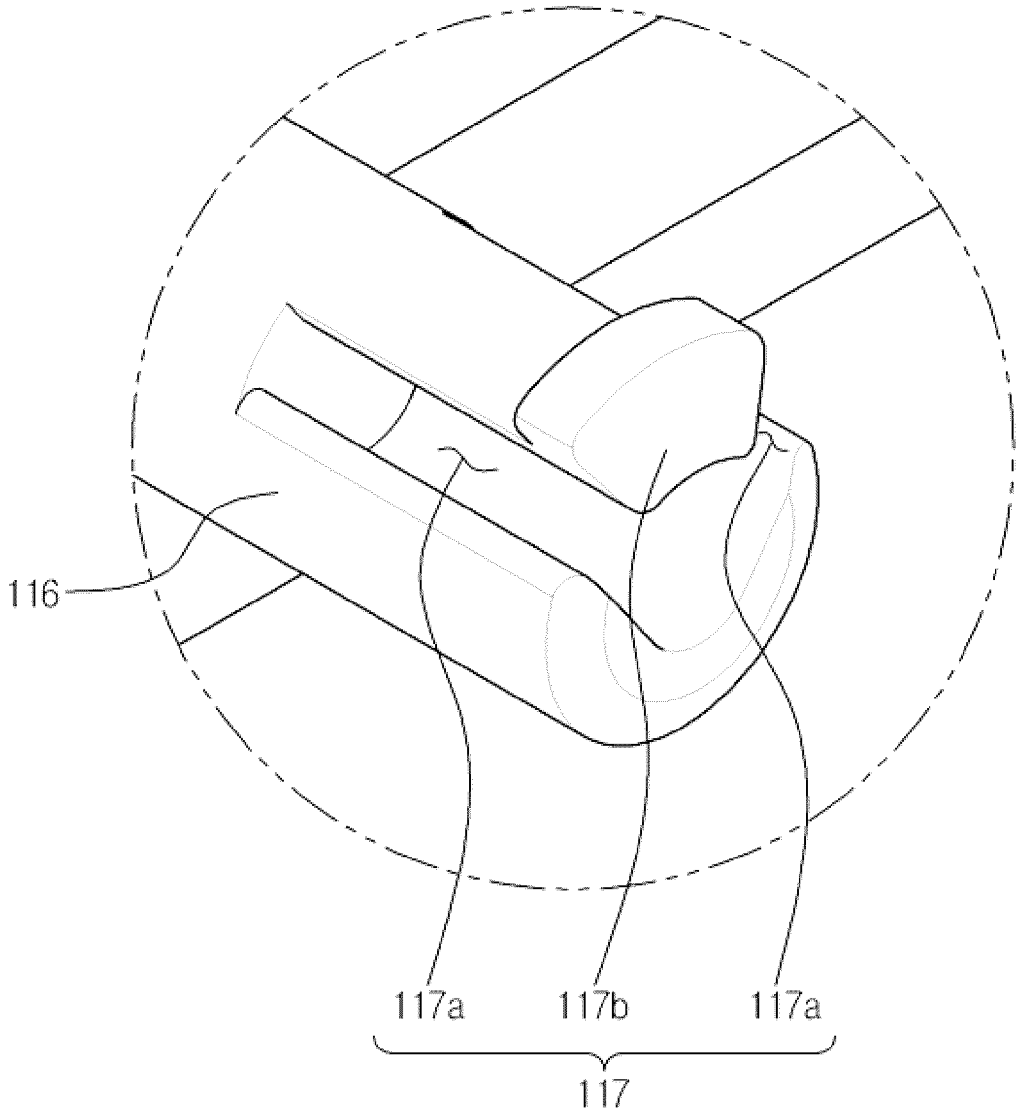
FIG. 6 is an enlarged view showing part 'A' of FIG. 5.
Figure 7A:
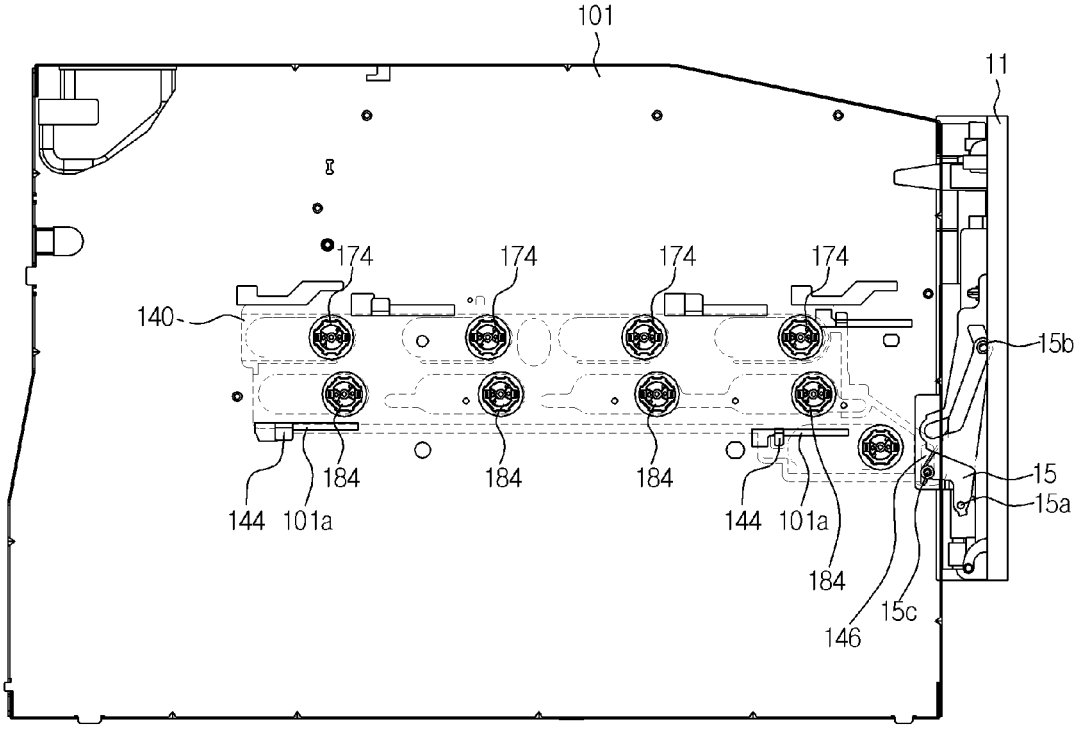
FIGS. 7A and 7B are views showing a cooperative relationship between a cover and a link member.
Figure 7B:
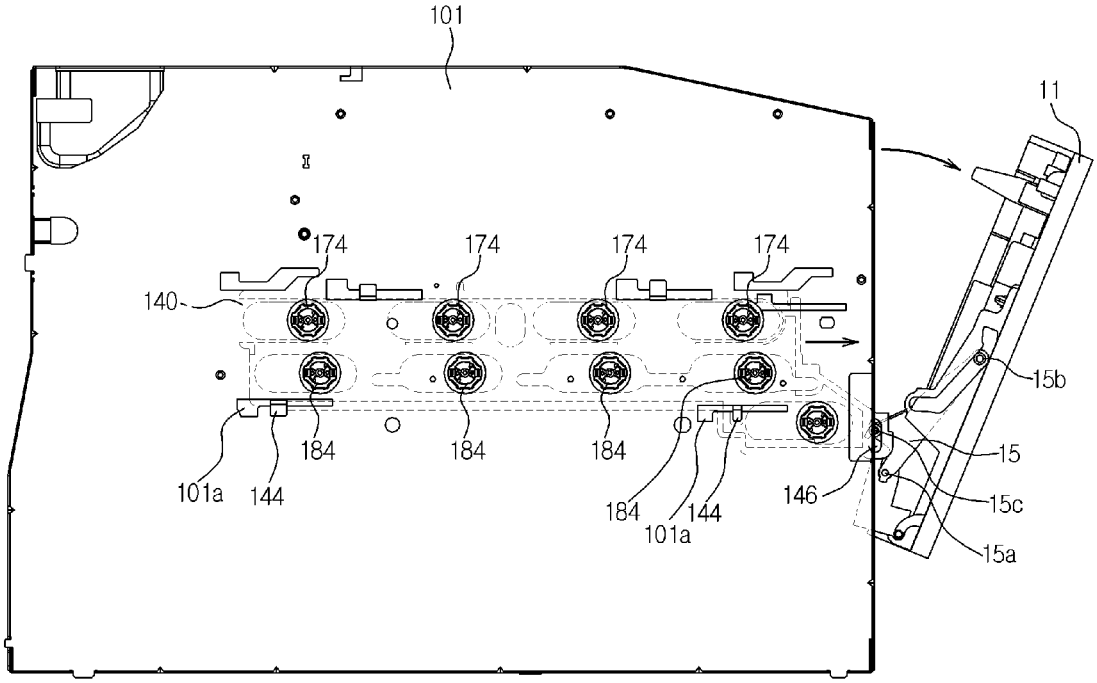

FIG. 2 is a view showing a driving structure according to an embodiment of the present inventive concept to drive a developing cartridge of FIG. 1, FIG. 3 is an exploded view of the construction shown in FIG. 2, FIG. 4 is an exploded view of the construction shown in FIG. 2, FIG. 5 is an exploded view of the construction shown in FIG. 4 when viewed from another angle, FIG. 6 is an enlarged view showing part 'A' of FIG. 5, and FIGS. 7A and 7B are views showing a cooperative relationship between the cover and a link member.

As shown in FIGS. 2 to 7B, a first support frame 101 is provided at one side of the main body 10 to support various components constituting the image forming apparatus 1, a second support frame 102 is disposed outside the first support frame 101 in a coupled state to rotatably support the first driving coupler member 170, and a third support frame 103 is disposed outside the second support frame 102 in a coupled state to rotatably support the second driving coupler member 180. At positions on the first support frame 101 there are provided through holes, corresponding to a first coupler 174 and a second coupler 184, through which the first coupler 174 and the second coupler 184 move through the first support frame 101.

To the first support frame 101, the second support frame 102, and the third support frame 103 are coupled a plurality of driving coupler members 170 and 180 to drive each of the developing cartridges 40Y, 40M, 40C, and 40K and a guide member 110 and a link member 140 to move the driving coupler members 170 and 180 so that the driving coupler members 170 and 180 are connected to or separated from each of the developing cartridges 40Y, 40M, 40C, and 40K.

The driving coupler members 170 and 180 include a first driving coupler member 170 to drive the developing roller 43 and a second driving coupler member 180 to drive the image carrier 41.

The first driving coupler member 170 includes a first rotary shaft 172 rotatably coupled to the second support frame 102, a first coupler 174 coupled to the first rotary shaft 172 so as to be movable in the axial direction of the first rotary shaft 172, and a first elastic member 176 disposed between the first coupler 174 and the second support frame 102 to press the first coupler 174 toward the developing cartridges 40Y, 40M, 40C, and 40K.

The first rotary shaft 172 is connected to a power transmission gear (not shown) to transmit a driving force from a driving motor (not shown) to rotate the first coupler 174.

The first coupler 174 includes a first flange 174*a* formed by extending the outer circumference of the first coupler 174 in the radial direction (FIG. 4). One side of the first flange 174*a* contacts the first elastic member 176 so that the first coupler 174 is pressed by the first elastic member 176, and the other side of the first flange 174*a* contacts the guide member 110 so that the first coupler 174 is supported by the guide member 110.

The second driving coupler member 180 includes a second rotary shaft 182 rotatably coupled to the third support frame 103, a second coupler 184 coupled to the second rotary shaft 182 so as to be movable in the axial direction of the second rotary shaft 182, and a second elastic member 186 disposed between the second coupler 184 and the third support frame 103 to press the second coupler 184 toward the developing cartridges 40Y, 40M, 40C, and 40K.

The second rotary shaft 182 is connected to a power transmission gear (not shown) to transmit a driving force from a driving motor (not shown) to rotate the second coupler 184.

The second coupler 184 includes a second flange 184*a* formed by extending the outer circumference of the second coupler 184 in the radial direction (FIG. 4). One side of the second flange 184*a* contacts the second elastic member 186 so that the second coupler 184 is pressed by the second elastic member 186, and the other side of the second flange 184*a* contacts the guide member 110 so that the second coupler 184 is supported by the guide member 110.

The first coupler 174 and the second coupler 184 are elastically supported by the first elastic member 176 and the second elastic member 186 through the first flange 174*a* and the second flange 184*a*, and are moved to the first rotary shaft 172 and the second rotary shaft 182 by the guide member 110, which operates simultaneously with opening and closing of the cover 11, in contact with the guide member 110 so that the first coupler 174 and the second coupler 184 are coupled to or separated from the developing cartridges 40Y, 40M, 40C, and 40K.

The guide member 110 is disposed between the first support frame 101 and the second support frame 102 to move the first coupler 174 and the second coupler 184 so that the first coupler 174 and the second coupler 184 are coupled to or separated from the developing cartridges 40Y, 40M, 40C, and 40K. The guide member 110 includes first receiving holes 112 formed at positions corresponding to the driving coupler members 170 and 180 to receive the first coupler 174 and the second coupler 184 so that the driving coupler members 170 and 180 are coupled to the developing cartridges 40Y, 40M, 40C, and 40K without interference with the guide member 110, a receiving part 114 to receive a pressing protrusion 142 provided at the link member 140 so that the guide member 110 operates simultaneously with the link member 140 according to opening and closing of the cover 11, and a first guide protrusion 116 and a second guide hole 118 connected to the second support frame 102 and the third support frame 103 so that the guide member 110 is movably supported by the second support frame 102 and the third support frame 103.

The first guide protrusion 116 protrudes from one side of the guide member 110 opposite to the second support frame 102 by a predetermined length so that the first guide protrusion 116 is slidably coupled to a first guide hole 102*a* formed at the second support frame 102.

As shown in FIGS. 5 and 6, the first guide protrusion 116 is provided at one end thereof with a hook 117 to prevent the guide member 110 from being separated from the second support frame 102. The hook 117 includes a cutout part 117*a* formed by cutting one end of the first guide protrusion 116 so that the first guide protrusion 116 is inserted through the first guide hole 102*a* and a hook protrusion 117*b* is formed by extending the outer circumference of the first guide protrusion 116 in the radial direction. The hook 117 is elastically deformed in the direction in which the radius of the first guide protrusion 116 is reduced when the guide member 110 is coupled to the second support frame 102 so that the first guide protrusion 116 is inserted through the first guide hole 102*a*. In a state in which the guide member 110 is coupled to the second support frame 102, the hook 117 returns to the original position thereof so that the hook protrusion 117*b* is caught by the second support frame 102 to prevent the guide member 110 from being separated from the second support frame 102.

The second guide hole 118 receives a second guide protrusion 103*a* protruding from one side of the third support frame 103 opposite to the guide member 110 by a predetermined length to movably support the guide member 110 simultaneously with the first guide protrusion 116.

A third elastic member 132 is disposed between the guide member 110 and the second support frame 102. Opposite ends of the third elastic member 132 are supported by one side of the guide member 110 and one side of the second support frame 102 to press the guide member 110 toward the developing cartridges 40Y, 40M, 40C, and 40K.

The link member 140 operates simultaneously with the cover 11 to press the guide member 110 so that the guide member 110 moves the first coupler 174 and the second coupler 184. The link member 140 includes a pressing protrusion 142 protruding from one side opposite to the guide member 110 by a predetermined length, a third guide protrusion 144 protruding from the other side opposite to the one side from which the pressing protrusion 142 protrudes, by a predetermined length, and through holes 145 formed at positions corresponding to the first coupler 174 and the second coupler 184 so that the first coupler 174 and the second coupler 184 move through the link member 140.

The pressing protrusion 142 is received in the receiving part 114 when the cover 11 is closed. When the cover 11 is opened, the pressing protrusion 142 is separated from the receiving part 114 to press the guide member 110.

When the pressing protrusion 142 is received in the receiving part 114, the guide member 110 moves toward the developing cartridges 40Y, 40M, 40C, and 40K. At this time, the first coupler 174 and the second coupler 184, each contacting the guide member 110, move toward the developing cartridges 40Y, 40M, 40C, and 40K simultaneously with the guide member 110 so that the first coupler 174 and the second coupler 184 are coupled to the driven coupler members 45 and 46. When the pressing protrusion 142 is separated from the receiving part 114, the guide member 110 is pressed by the pressing protrusion 142 to move away from the developing cartridges 40Y, 40M, 40C, and 40K. At this time, the first coupler 174 and the second coupler 184, contacting the guide member 110, are pressed by the guide member 110 to move away from the developing cartridges 40Y, 40M, 40C, and 40K simultaneously with the guide member 110 so that the first coupler 174 and the second coupler 184 are separated from the driven coupler members 45 and 46.

The third guide protrusion 144 is slidably coupled to a first guide slot 101*a* formed at the first support frame 101 (FIGS. 2 and 3) so that the third guide protrusion 144 is supported by the first support frame 101 when the link member 140 is moved simultaneously with the cover 11.

As shown in FIGS. 7A and 7B, the link member 140 is connected to the cover 11 via a connection link 15 and operates simultaneously with the cover 11 according to opening and closing of the cover 11.

One end 15*a* of the connection link 15 is rotatably coupled to the main body 10 so that the cover 11 is rotated about the end 15*a* of the connection link 15, and the other end 15*b* of the connection link 15 is slidably coupled to the cover 11 to restrict a rotational angle of the cover 11 so that the cover 11 is prevented from being rotated by more than a predetermined angle.

A coupling protrusion 15*c* protruding upward from a body of the connection link 15 between one end 15*a* and the other end 15*b* of the connection link 15 is coupled to a second guide slot 146 formed at the link member 140 so that the link member 140 operates simultaneously with the cover 11, when the cover 11 is rotated, to move in the forward and backward direction of the main body 10.

Figure 8:
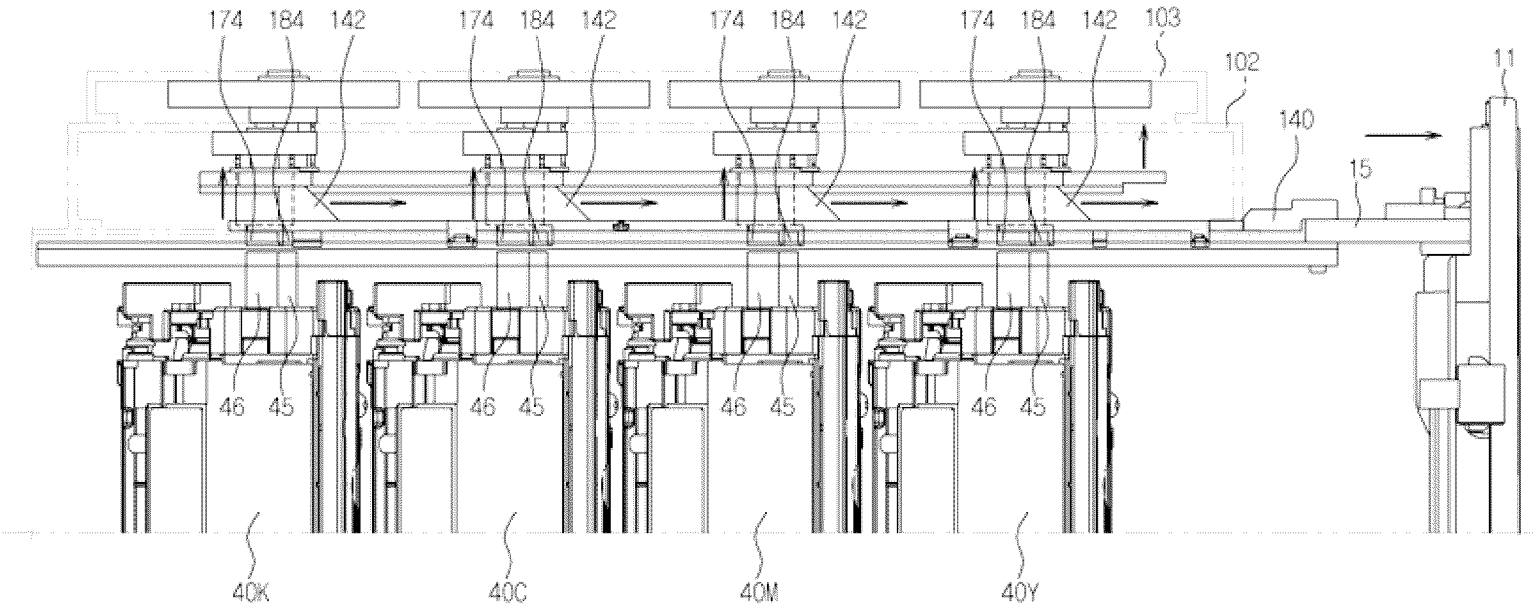
FIG. 8 is a view showing that couplers move in a second direction to be separated from the developing cartridge when the cover opens a main body.
Figure 9:
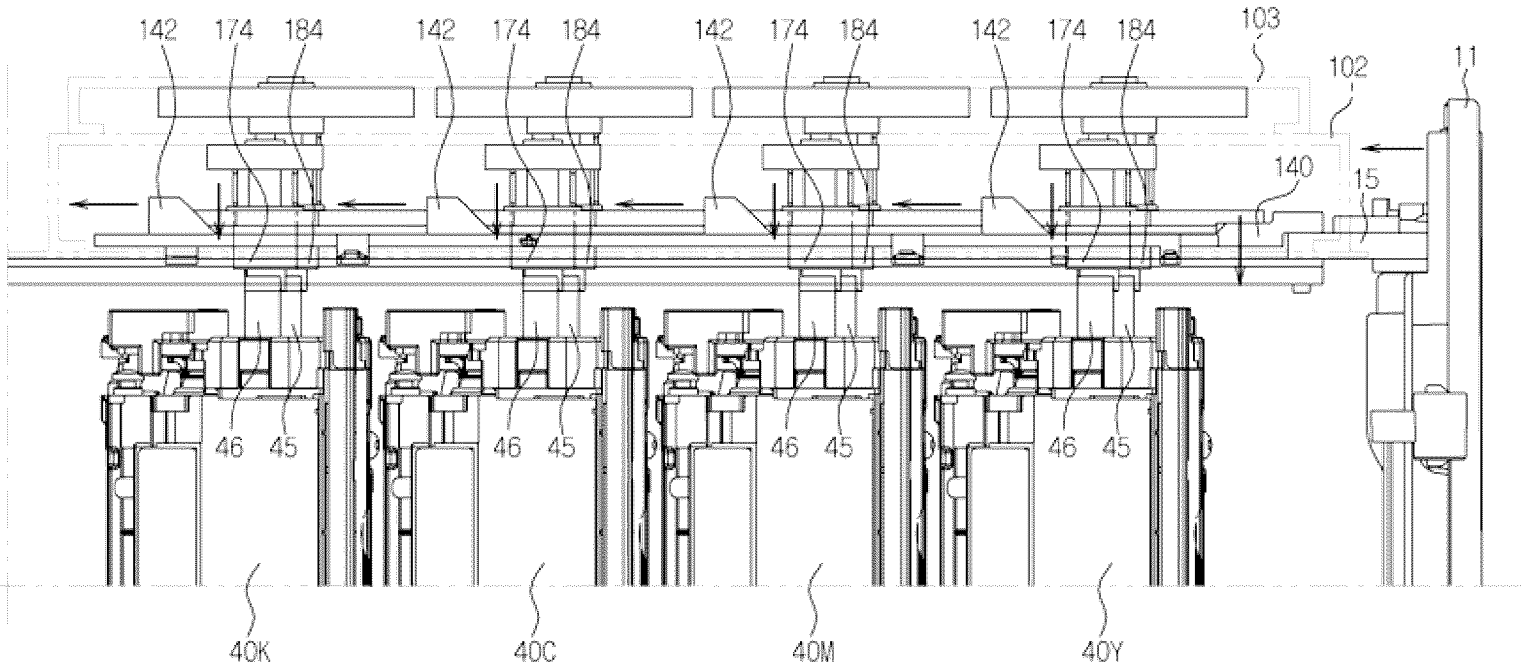
FIG. 9 is a view showing that the couplers move in a fourth direction to be coupled to the developing cartridge when the cover closes the main body.

FIG. 8 is a view showing that each of the pair of couplers 174 and 184 move in a second direction to be separated from the respective developing cartridge when the cover 11 opens the main body 10, and FIG. 9 is a view showing that each of the pair of couplers 174 and 184 move in a fourth direction to be coupled to the respective developing cartridge when the cover 11 closes the main body 10.

For the convenience of description, the second direction described above is defined as a direction in which the guide member 110, the first coupler 174, and the second coupler 184 move away from the developing cartridges 40Y, 40M, 40C, and 40K, the fourth direction described above is defined as a direction in which the guide member 110, the first coupler 174, and the second coupler 184 move toward the developing cartridges 40Y, 40M, 40C, and 40K, i.e. a direction opposite to the second direction, a first direction is defined as a direction perpendicular to the second direction and the fourth direction, in which the link member 140 moves outside the main body 10 (i.e. toward and out of the cover 11), and a third direction is defined as a direction opposite to the first direction (i.e. inside the main body 10 through the cover 11). Here, the second direction and the fourth direction are identical to the direction in which the first rotary shaft 172 and the second rotary shaft 182 extend.

As shown in FIG. 8, when a user opens the cover 11 more than a predetermined angle to replace the developing cartridges 40Y, 40M, 40C, and 40K, the connection link 15 connected to the cover 11 and the link member 140 connected to the connection link 15 are slid in the first direction, and the pressing protrusion 142 of the link member 140, received in the receiving part 114 of the guide member 110, is separated from the receiving part 114 and presses one side of the guide member 110.

When one side of the guide member 110 is pressed by the pressing protrusion 142 as a result of the pressing protrusion 142 being separated from the receiving part 114, the guide member 110 is slid in the second direction, which is perpendicular to the first direction, simultaneously with the sliding of the link member 140 in the first direction. At this time, the first coupler 174 and the second coupler 184, contacting the guide member 110, are pressed by the guide member 110 to move away from the developing cartridges 40Y, 40M, 40C, and 40K together with the guide member 110. As a result, the first coupler 174 and the second coupler 184 are separated from the driven coupler members 45 and 46.

In a state in which the first coupler 174 and the second coupler 184 are separated from the driven coupler members 45 and 46 and thus do not interfere with the developing cartridges 40Y, 40M, 40C, and 40K, the user may fully open the cover 11 and pull the tray 80 so that the developing cartridges 40Y, 40M, 40C, and 40K are fully exposed outside the main body 10 to replace one or a plurality of the developing cartridges 40Y, 40M, 40C, and 40K.

As shown in FIG. 9, when the user replaces the developing cartridges 40Y, 40M, 40C, and 40K and closes the cover 11 so that new developing cartridges 40Y, 40M, 40C, and 40K are mounted in the main body 10, the connection link 15 connected to the cover 11 and the link member 140 connected to the connection link 15 are slid in the second direction, and the pressing protrusion 142 of the link member 140, pressing one side of the guide member 110, becomes received in the receiving part 114. As a result, pressing of the guide member 110 by the pressing protrusion 142 is released.

When the pressing protrusion 142 is received in the receiving part 114, the guide member 110 is slid in the fourth direction simultaneously with the movement of the link member 140. At this time, the first coupler 174 and the second coupler 184, contacting the guide member 110, are pressed by the guide member 110 to move toward the developing cartridges 40Y, 40M, 40C, and 40K simultaneously with the guide member 110. As a result, the first coupler 174 and the second coupler 184 are coupled to the driven coupler members 45 and 46 so that the developing cartridges 40Y, 40M, 40C, and 40K are driven.

Since the direction in which force is applied from the guide member 110 to the first coupler 174 and the second coupler 184 coincides with the direction in which the first coupler 174 and the second coupler 184 are moved as described above, the developing cartridges 40Y, 40M, 40C, and 40K are stably mounted or separated using a small force, thereby improving product durability.

Figure 10:
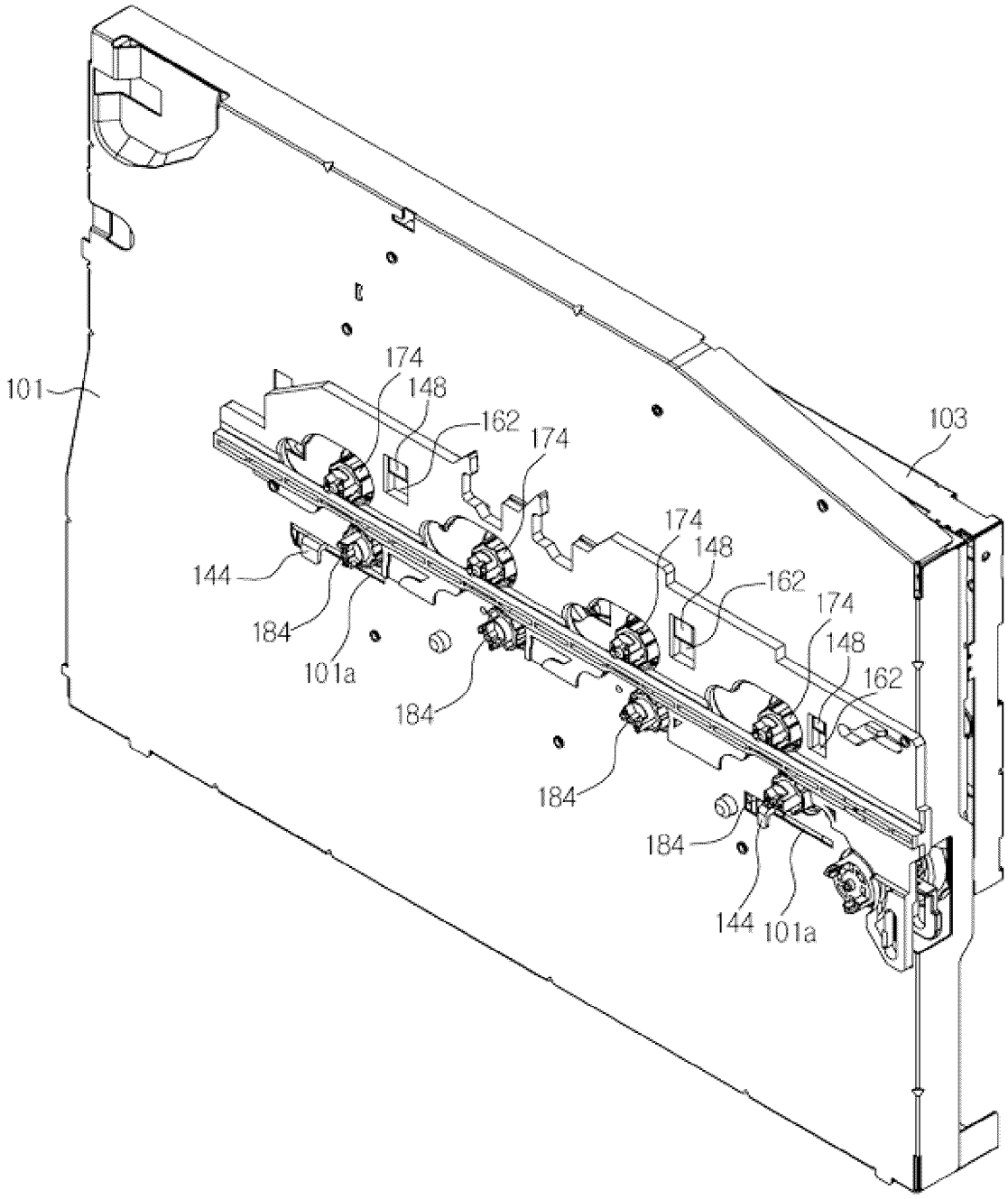
FIG. 10 is a view showing a driving structure according to another exemplary embodiment of the present inventive concept.
Figure 11:
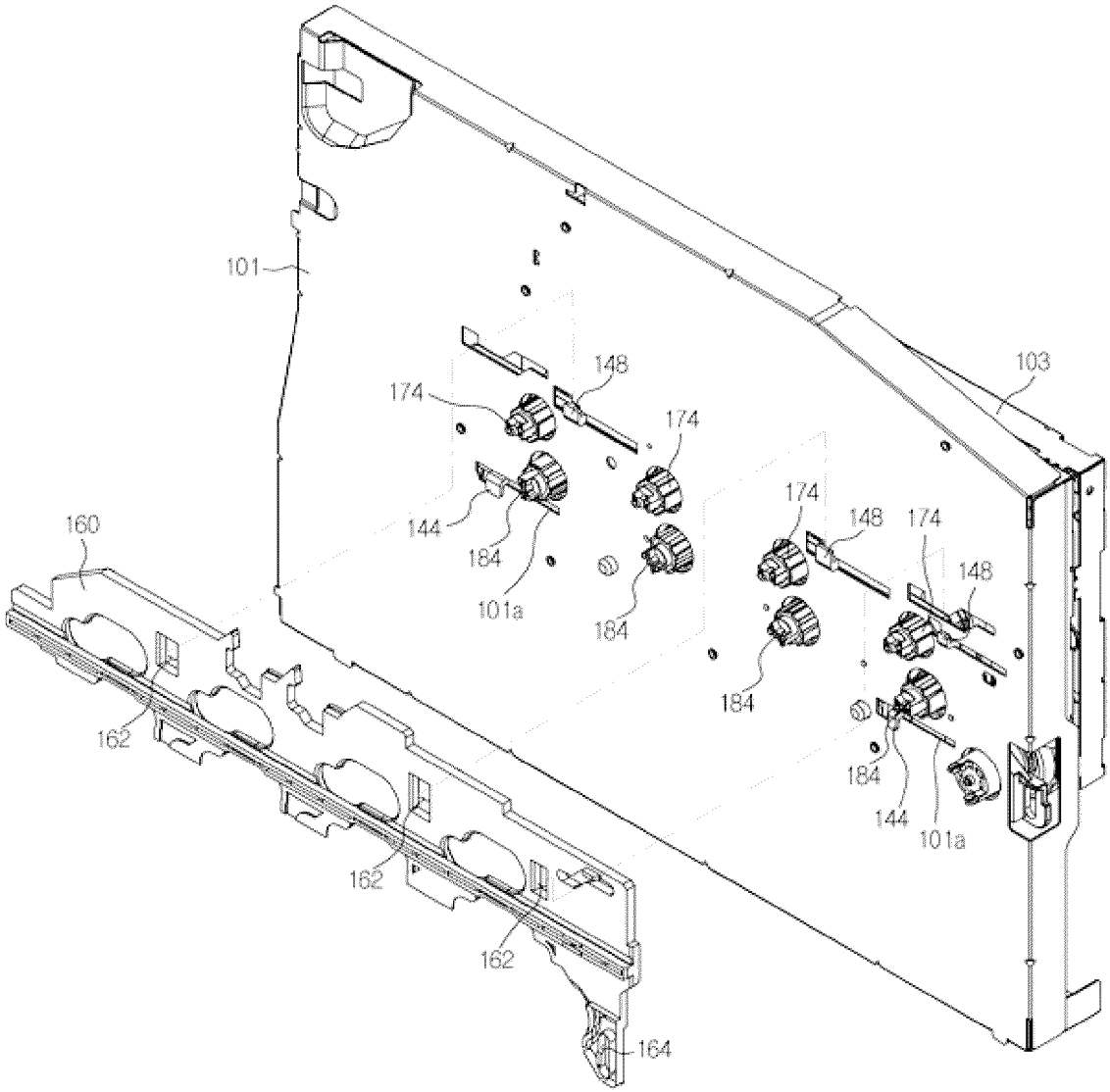
FIG. 11 is an exploded view of the construction shown in FIG. 10.
Figure 12A:
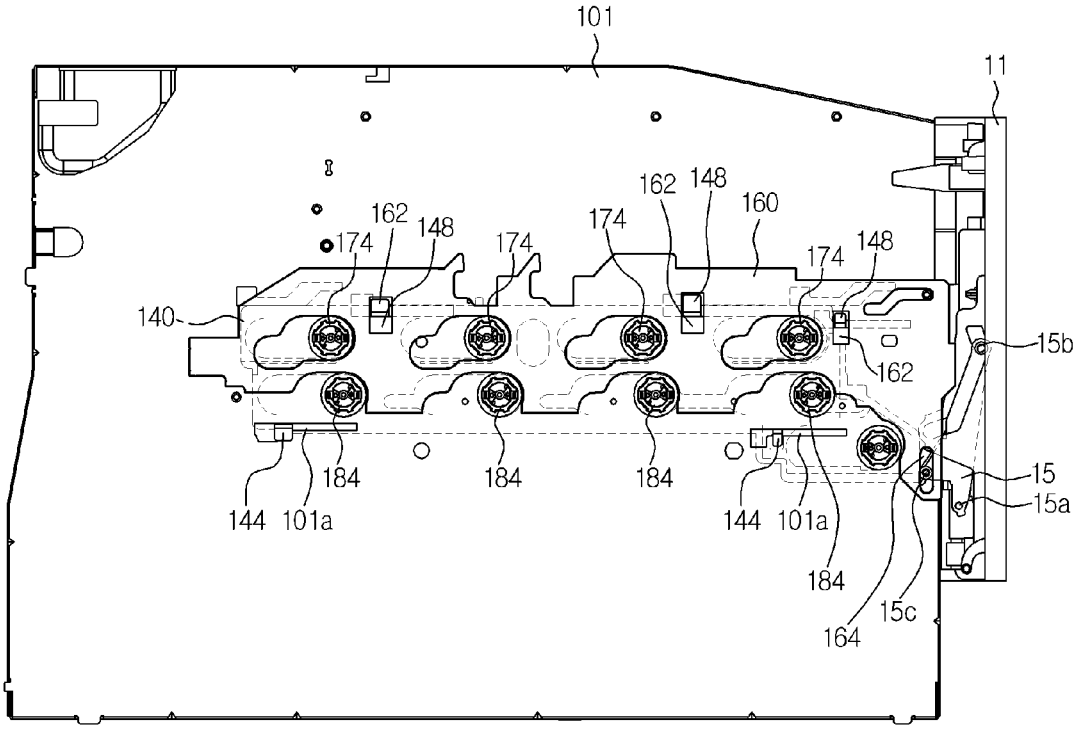
FIGS. 12A and 12B are views showing a cooperative relationship between the cover and a rail member.
Figure 12B:
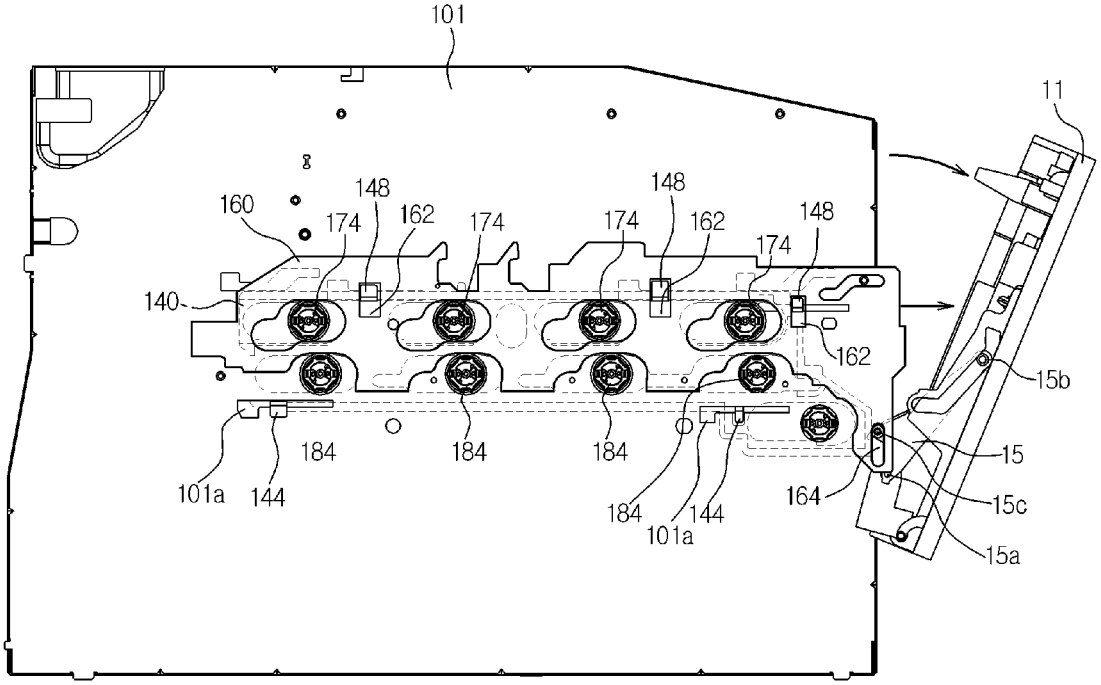

FIG. 10 is a view showing a driving structure according to another embodiment of the present inventive concept, FIG. 11 is an exploded view of the construction shown in FIG. 10, and FIGS. 12A and 12B are views showing a cooperative relationship between the cover and a rail member.

As shown in FIGS. 10 to 12B, the link member 140 operates simultaneously with a rail member 160 when the cover 11 is opened or closed.

The link member 140 includes a coupling protrusion 148 protruding from an opposite side of the link member 140 with respect to the side of the link member 140 from which the pressing protrusion 142 protrudes. The coupling protrusion 148 protrudes from the link member 140 by a predetermined length so that the coupling protrusion 148 is coupled to the rail member 160. The rail member 160 includes a coupling hole 162 to receive the coupling protrusion 148 so that the coupling protrusion 148 is coupled to the coupling hole 162.

As shown in FIGS. 12A and 12B, the rail member 160 is connected to the cover 11 via the connection link 15 and operates simultaneously with the cover 11 according to opening and closing of the cover 11.

One end 15*a* of the connection link 15 is rotatably coupled to the main body 10 so that the cover 10 is rotated about the end 15*a* of the connection link 15, and the other end 15*b* of the connection link 15 is slidably coupled to the cover 11 to restrict a rotational angle of the cover 11 so that the cover 11 is prevented from being rotated by more than a predetermined angle.

The coupling protrusion 15*c* protruding outwardly from the body of the connection link 15 between one end 15*a* and the other end 15*b* of the connection link 15 is received and coupled in a third guide slot 164 formed at the rail member 160 so that the rail member 160 operates simultaneously with the cover 11, when the cover 11 is rotated, to move in the forward and backward direction of the main body 10.

Other construction and principle except the structure in which the link member 140 is coupled to the rail member 160 via the coupling protrusion 148 and operates simultaneously with the rail member 160 are identical to those of the driving structure of the previous embodiment, and therefore, a description thereof will be omitted.

Figure 13:
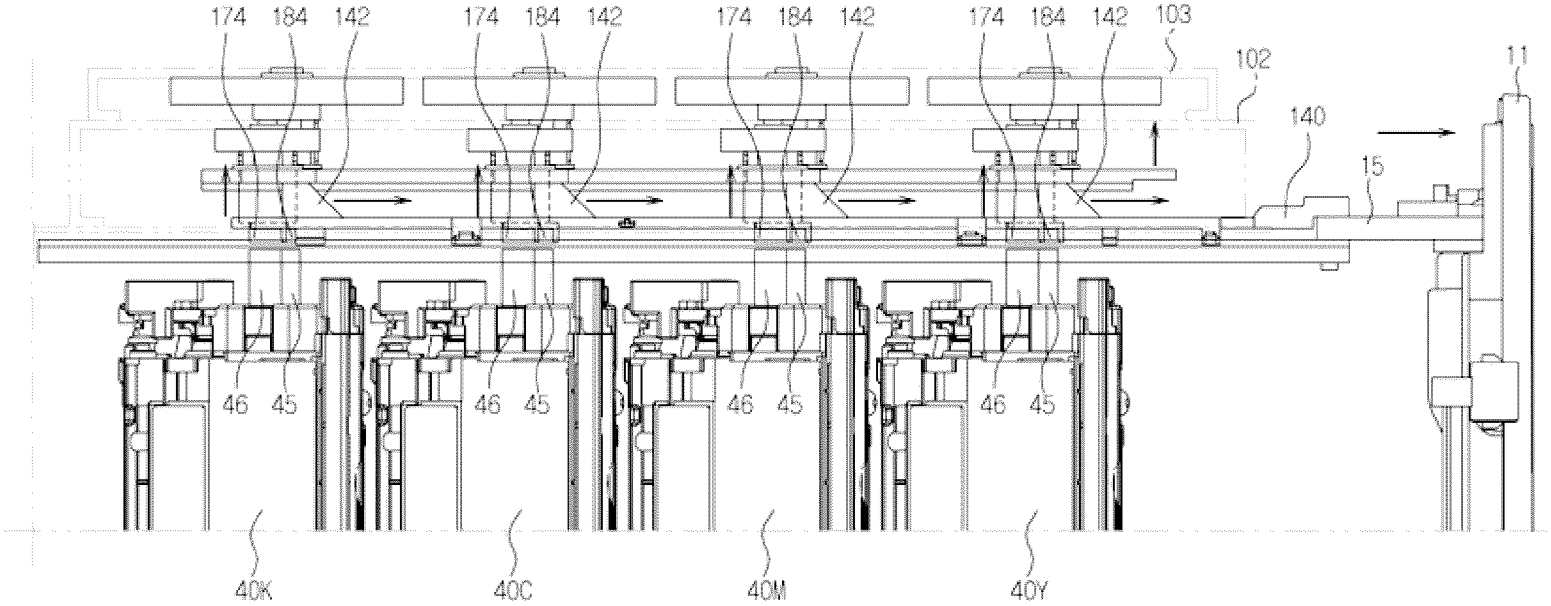
FIG. 13 is a view showing that the couplers move in the second direction to be separated from the developing cartridge when the cover opens the main body.
Figure 14:
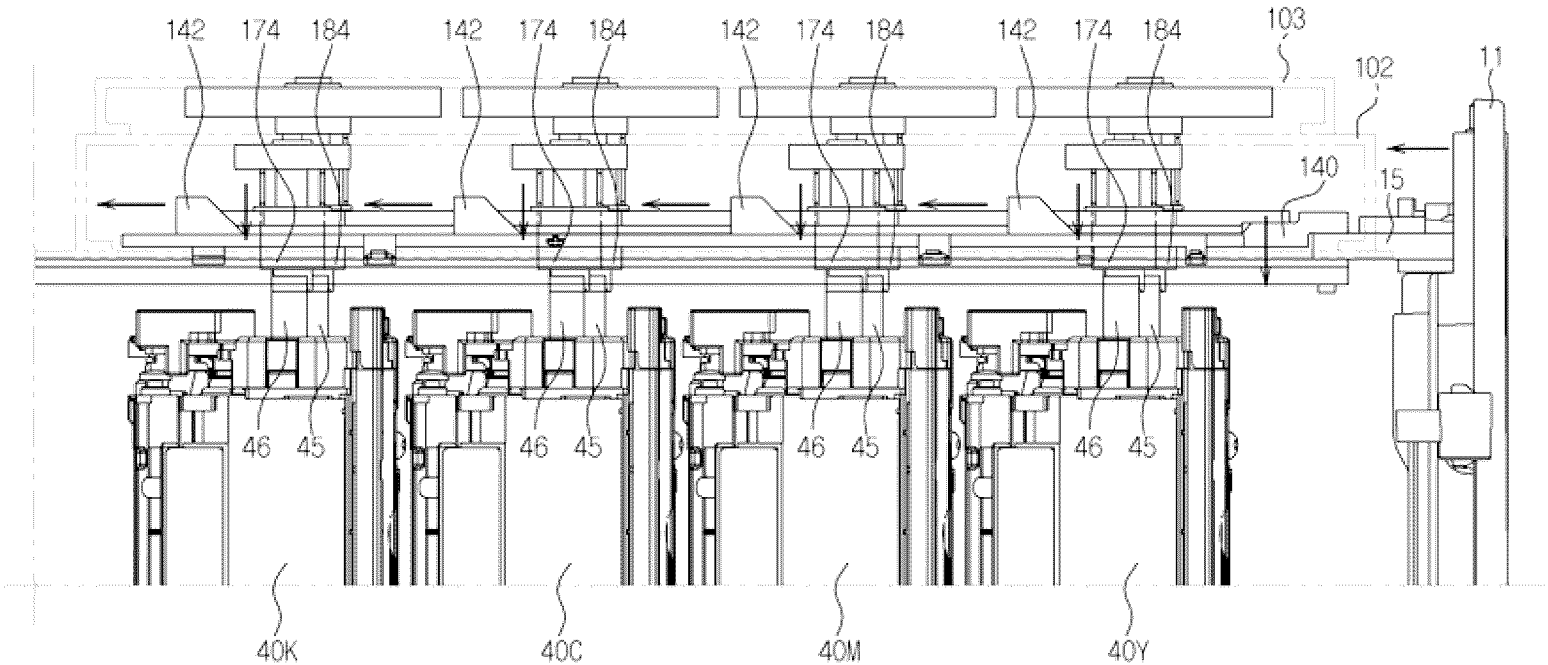
FIG. 14 is a view showing that the couplers move in the fourth direction to be coupled to the developing cartridge when the cover closes the main body.

FIG. 13 is a view showing that the couplers move in the second direction to be separated from the developing cartridge when the cover opens the main body, and FIG. 14 is a view showing that the couplers move in the fourth direction to be coupled to the developing cartridge when the cover closes the main body.

As shown in FIG. 13, when a user opens the cover 11 more than a predetermined angle to replace the developing cartridges 40Y, 40M, 40C, and 40K, the connection link 15 connected to the cover 11 and the rail member 160 connected to the connection link 15 are slid in the first direction, the link member 140, coupled to the rail member 160 via the coupling protrusion 148, is slid in the first direction together with the rail member 160, and the pressing protrusion 142 of the link member 140, received in the receiving part 114 of the guide member 110, is separated from the receiving part 114 to press one side of the guide member 110.

When one side of the guide member 110 is pressed by the pressing protrusion 142, the guide member 110 is slid in the second direction, which is perpendicular to the first direction, simultaneously with the movement of the link member 140. At this time, the first coupler 174 and the second coupler 184, contacting the guide member 110, are pressed by the guide member 110 to move away from the developing cartridges 40Y, 40M, 40C, and 40K together with the guide member 110. As a result, the first coupler 174 and the second coupler 184 are separated from the driven coupler members 45 and 46.

In a state in which the first coupler 174 and the second coupler 184 are separated from the driven coupler members 45 and 46 and thus do not interfere with the developing cartridges 40Y, 40M, 40C, and 40K, a user may fully open the cover 11 and pull the tray 80 so that the developing cartridges 40Y, 40M, 40C, and 40K are fully exposed outside the main body 10 to replace one or more of the developing cartridges 40Y, 40M, 40C, and 40K.

As shown in FIG. 14, when the user replaces the developing cartridges 40Y, 40M, 40C, and 40K and closes the cover 11 so that new developing cartridges 40Y, 40M, 40C, and 40K are mounted in the main body 10, the connection link 15 connected to the cover 11 and the rail member 160 connected to the connection link 15 are slid in the first direction, the link member 140 is slid in the first direction together with the rail member 160, and the pressing protrusion 142 of the link member 140, pressing one side of the guide member 110, is received in the receiving part 114. As a result, pressing of the guide member 110 is released.

When the pressing protrusion 142 is received in the receiving part 114, the guide member 110 is slid in the fourth direction simultaneously with the movement of the link member 140. At this time, the first coupler 174 and the second coupler 184, contacting the guide member 110, are pressed by the guide member 110 to move toward the developing cartridges 40Y, 40M, 40C, and 40K together with the guide member 110. As a result, the first coupler 174 and the second coupler 184 are coupled to the driven coupler members 45 and 46 so that the developing cartridges 40Y, 40M, 40C, and 40K are driven.

As is apparent from the above description, the number of parts constituting the driving structure to drive the developing cartridges is reduced, thereby reducing material cost and improving productivity.

Also, the direction in which force is applied to the couplers constituting the driving structure coincides with the direction in which the couplers are moved, and therefore, the developing cartridges are stably mounted or separated using small force, thereby improving product durability.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a main body;

a cover to open and close a front of the main body;

a tray slidably mounted in the main body through the front of the main body opened by the cover;

a plurality of developing cartridges mounted in the main body in a state in which the developing cartridge is received in the tray;

a plurality of driving coupler members provided at one side of the main body to drive the developing cartridges mounted in the main body;

a link member operating simultaneously with opening and closing of the cover to move in a first direction, the first direction being parallel to a direction in which the tray moves; and a guide member to support the driving coupler members, the guide member operating simultaneously with the link member to move in a second direction perpendicular to the first direction, wherein the guide member is pressed by the link member, when the cover opens the main body, to separate the driving coupler members from the developing cartridges so that the developing cartridges and the driving coupler members do not interfere with each other when the tray is slid in the first direction.

2. The image forming apparatus according to claim 1, wherein the developing cartridges each comprises a driven coupler member to couple to and separate from the corresponding driving coupler member.

3. The image forming apparatus according to claim 2, wherein the developing cartridges each comprises an image carrier to form an image and a developing roller to supply a developing agent to the image carrier, and the driven coupler members are each connected to the corresponding image carriers and/or the developing rollers.

4. The image forming apparatus according to claim 1, wherein pressing of the guide member by the link member is released when the cover closes the main body to couple the driving coupler members to the developing cartridges so that the developing cartridges are driven by the driving coupler members.

5. The image forming apparatus according to claim 1, wherein the second direction is the same as a rotational axial direction of the driving coupler members.

6. The image forming apparatus according to claim 1, wherein, when the cover opens the main body, the guide member is pressed by the link member to move in the second direction, and the driving coupler members are pressed by the guide member to move in the second direction so that the driving coupler member is disposed at a first position where the driving coupler members are separated from the developing cartridges.

7. The image forming apparatus according to claim 1, wherein, when the cover closes the main body, pressing of the guide member by the link member is released so that the guide member moves in a direction opposite to the second direction, and pressing of the driving coupler members by the guide member is released so that the driving coupler members move in the direction opposite to the second direction and are disposed at a second position where the driving coupler members are coupled to the developing cartridges.

8. The image forming apparatus according to claim 1, further comprising:

a support frame coupled to one side of the main body to rotatably support the driving coupler member, wherein the driving coupler member comprises:

a rotary shaft rotatably coupled to the support frame;

a coupler coupled to the rotary shaft so that the coupler moves in an axial direction of the rotary shaft; and a first elastic member disposed between the coupler and the support frame to press the coupler in a direction opposite to the second direction.

9. The image forming apparatus according to claim 8, wherein the guide member comprises a guide protrusion protruding from one side thereof in the second direction, and the support frame comprises a guide hole to guide the guide protrusion so that the guide member moves in the second direction or in a direction opposite to the second direction.

10. The image forming apparatus according to claim 9, further comprising a second elastic member disposed between the guide member and the support frame to press the guide member in the direction opposite to the second direction.

11. The image forming apparatus according to claim 1, wherein the link member comprises a pressing protrusion contacting the guide member, when the cover opens the main body, to press the guide member.

12. The image forming apparatus according to claim 11, wherein the guide member comprises a receiving part to receive the pressing protrusion, when the cover closes the main body, so that the pressing protrusion does not interfere with the link member.

13. The image forming apparatus according to claim 12, wherein the guide member comprises at least one receiving hole formed at a position corresponding to the driving coupler member to receive the driving coupler member so that the driving coupler member is coupled to the developing cartridge without interference with the guide member.

14. An image forming apparatus comprising:

a main body;

a cover to open and close a front of the main body;

a tray slidably mounted in the main body through the front of the main body opened by the cover;

at least one developing cartridge mounted in the main body in a state in which the developing cartridge is received in the tray, the developing cartridge comprising an image carrier to form an image, a developing roller to supply a developing agent to the image carrier, and a plurality of driven coupler members connected to the image carrier and the developing roller;

a plurality of driving coupler members provided at one side of the main body to transmit driving force generated from a driving source to the driven coupler members;

a link member operating simultaneously with opening and closing of the cover to move in a first direction, the link member moving in a direction in which the tray is separated from the main body when the cover opens the main body and moving in a direction in which the tray is coupled to the main body when the cover closes the main body; and a guide member operating simultaneously with the link member to move in an axial direction of the driving coupler members, the guide member being pressed by the link member, when the cover opens the main body, to separate the driving coupler members from the driven coupler members, pressing of the guide member by the link member is released, when the cover closes the main body, to couple the driving coupler members to the driven coupler members.

15. The image forming apparatus according to claim 14, wherein the guide member is pressed by the link member, when the cover opens the main body, to move in an axial direction of the driving coupler members in which the guide member moves away from the developing cartridge, and pressing of the guide member by the link member is released, when the cover closes the main body, so that the guide member moves in the axial direction of the driving coupler members in which the guide member moves closer to the developing cartridge.

16. The image forming apparatus according to claim 14, wherein the link member comprises a pressing protrusion protruding from one side thereof to press the guide member when the cover opens the main body.

17. The image forming apparatus according to claim 16, wherein the guide member comprises a receiving part formed at a position corresponding to the pressing protrusion to receive the pressing protrusion when the cover closes the main body.

18. The image forming apparatus according to claim 17, wherein the driving coupler members comprise at least one first driving coupler member to drive the developing roller and at least one second driving coupler member to drive the image carrier.

19. The image forming apparatus according to claim 18, comprising:

a first support frame disposed at one side of the main body to support various components constituting the image forming apparatus;

a second support frame disposed outside the first support frame to rotatably support the at least one first driving coupler member; and a third support frame disposed outside the second support frame to rotatably support the at least one second driving coupler member.

20. The image forming apparatus according to claim 19, wherein the link member and the guide member are disposed between the first support frame and the second support frame.

21. The image forming apparatus according to claim 20, wherein the first driving coupler member comprises:

a first rotary shaft rotatably coupled to the second support frame;

a first coupler coupled to the first rotary shaft so as to be movable in an axial direction of the first rotary shaft; and a first elastic member disposed between the first coupler and the second support frame to press the first coupler in a direction opposite to the second direction.

22. The image forming apparatus according to claim 21, wherein the first coupler comprises a first flange formed by extending an outer circumference of the first coupler in a radial direction, and one side of the first flange contacts the first elastic member so that the first coupler is pressed by the first elastic member, and the other side of the first flange contacts the guide member so that the first coupler is supported by the guide member.

23. The image forming apparatus according to claim 19, wherein the guide member comprises a first guide protrusion protruding from one side thereof in the second direction, and the second support frame comprises a first guide hole to guide the first guide protrusion so that the guide member is moved in the second direction or in a direction opposite to the second direction.

24. The image forming apparatus according to claim 23, wherein the first guide protrusion is provided at one end thereof with a hook to prevent the guide member from being separated from the second support frame.

25. The image forming apparatus according to claim 19, wherein the third support frame comprises a second guide protrusion protruding from one side thereof in a direction opposite to the second direction, and the guide member comprises a second guide hole coupled to the second guide protrusion to guide the second guide protrusion.

26. The image forming apparatus according to claim 19, wherein the link member comprises a third guide protrusion protruding from one side thereof in a direction opposite to the second direction, and the first support frame comprises a guide slot to guide the third guide protrusion so that the link member is moved in the first direction or in a direction opposite to the first direction.

27. The image forming apparatus according to claim 14, comprising:

a rail member coupled to the cover and operating simultaneously with opening and closing of the cover to move in a first direction to guide sliding of the tray, wherein the link member comprises a coupling protrusion protruding from one side thereof in a direction opposite to the second direction and coupled to the rail member so that the link member operates simultaneously with the rail member.

28. An image forming apparatus comprising:

a main body;

a cover to open and close a front of the main body;

a tray slidably mounted in the main body through the front of the main body opened by the cover;

a plurality of developing cartridges mounted in the main body in a state in which the developing cartridges are received in the tray;

a rail member coupled to the cover and operating simultaneously with opening and closing of the cover to move in a first direction to guide sliding of the tray;

a link member operating simultaneously with the rail member to move in a first direction, the first direction being parallel to a direction in which the tray moves;

a guide member operating simultaneously with the link member to move in a second direction perpendicular to the first direction; and a plurality of driving coupler members provided at one side of the main body to drive the developing cartridges mounted in the main body, the driving coupler members operating simultaneously with the guide member to move in the second direction.

* * * * *